US005314302A

United States Patent [19]

Kakizawa et al.

[11] Patent Number: 5,314,302

[45] Date of Patent: May 24, 1994

[54] CENTRIFUGAL PUMP FOR SUPPLYING HOT LIQUID FROM A CONTAINER

[75] Inventors: Goro Kakizawa, Tokyo; Tadashi Fukami, Kanagawa, both of Japan

[73] Assignee: Ohken Seiko Co., Ltd., Inagi, Japan

[21] Appl. No.: 19,260

[22] Filed: Feb. 18, 1993

[30] Foreign Application Priority Data

Feb. 18, 1992 [JP] Japan ..... 4-061035
Apr. 27, 1992 [JP] Japan ..... 4-131447

[51] Int. Cl.[5] ..... F04D 29/70

[52] U.S. Cl. ..... 415/169.1; 96/194; 96/214

[58] Field of Search ..... 415/169.1, 206, 208.1, 415/208.2; 55/189, 190, 191, 192, 193; 417/77

[56] References Cited

U.S. PATENT DOCUMENTS 2,291,138 7/1942 Blom ..... 415/169.1
2,463,251 3/1949 Curtis ..... 415/169.1
3,976,452 8/1976 Meier et al. ..... 55/192
4,340,340 7/1982 Brown et al. ..... 55/190
4,447,189 5/1984 Jensen et al. ..... 55/204
4,932,837 6/1990 Rymal ..... 415/169.1

FOREIGN PATENT DOCUMENTS 0526494 6/1931 Fed. Rep. of Germany ... 415/208.1

*Primary Examiner*—Edward K. Look
*Assistant Examiner*—Mark Sgantzos
*Attorney, Agent, or Firm*—Cushman, Darby & Cushman

[57] ABSTRACT

An impeller pump which can be connected for use with hot-water serving systems. By the rotation of an impeller, liquids are sucked through a suction port which is connected with a container of the hot-water serving system and discharged through a discharge port for the intended supply. A guide port is provided nearby the suction port to let escape bubbles from the pump chamber, thereby assuring that the hot-water supply capacity performance is kept constant.

8 Claims, 4 Drawing Sheets

CENTRIFUGAL PUMP FOR SUPPLYING HOT LIQUID FROM A CONTAINER

BACKGROUND OF THE INVENTION a) Field of the Invention

This invention relates to an impeller pump for use with hot-water serving systems to supply hot water.

b) Description of the prior art

An impeller pump is used to supply hot water from the hot water serving system, such as a jar and pot. As shown in FIG. 1, the impeller pump has a suction port connected through a connecting member 34 with a bottom opening of a hot water container 20. In FIG. 1, the impeller pump comprises a pump casing 21, a partition plate 22 for gas-tightly separating a pump chamber 23 from a driving device 24, and a shaft 25 supported by a supporting member 26. A retaining member 27 is used to keep an impeller 28, which is rotatably placed on the shaft 25, and a driven magnet 29, respectively. A driving magnet 30 is rotated by an electric motor 31.

In the impeller pump of FIG. 1, the driving magnet 30 is rotated by the electric motor 31. The driven magnet 29 is then rotated by the magnetic coupling action between the driving magnet 30 and the driven magnet 29, thereby causing the impeller 28 to rotate. Thus, due to the rotation of the impeller, hot water in the container 20 is sucked into the pump chamber 23 through the inlet port 32, and then discharged out of the pump through a discharge port 33 for the intended supply.

When hot water is being supplied by using such an impeller pump, there is a problem that bubbles are generated in the pump chamber. Particularly, the pressure in a region around the impeller's axis of rotation becomes lower than elsewhere. Thus, bubbles generated tend to gather around the axis of rotation and choke off the suction port, thereby obstructing the flow of hot water, substantially lowering the hot water supply capacity and often stopping the hot water supply.

SUMMARY OF THE INVENTION

The object of this invention is to provide an impeller pump for use with the hot-water service system, etc., which pump removes bubbles likely to occur in the pump chamber and thus the pump's hot water supply capacity performance remains constant and unaffected.

The impeller pump of this invention is such that liquids such as hot water are sucked through the suction port due to the rotation of the impeller and then discharged through the discharge port for the intended liquids supply. The pump has a distinctive feature of forming a guide port in or around the suction port to let escape bubbles that have been generated in the pump chamber, thereby avoiding the problem of blocking the flow of liquids and thus keeping constant the hot-water supply capacity performance.

DETAILED DESCRIPTION OF THE PREFERRED EMBODIMENTS

Figure 2:
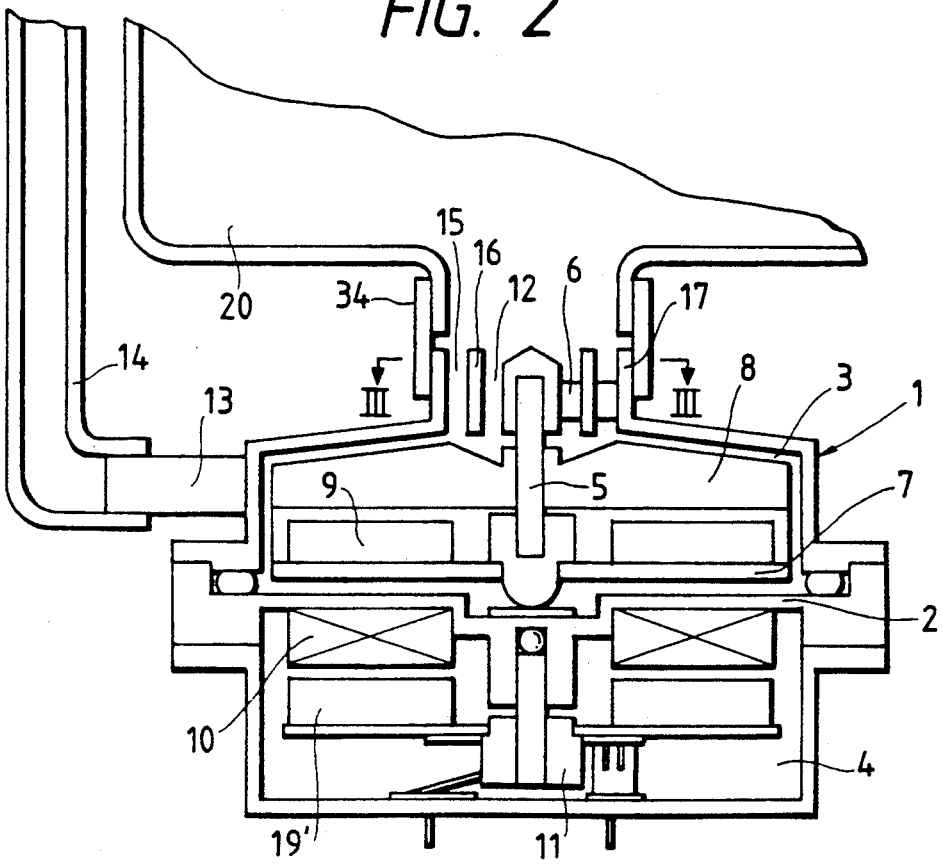
FIG. 2 is a cross-sectional view of the first embodiment of an impeller pump embodying this invention.
Figure 3:
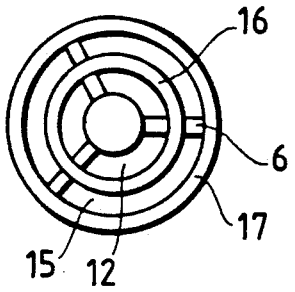
FIG. 3 is a cross-sectional view taken on line III—III of FIG. 2.

FIGS. 2 and 3 are views of a first embodiment of an impeller pump in accordance with this invention. FIG. 2 is a cross-sectional view of the impeller pump, and FIG. 3 is a cross-sectional view taken on line III—III of FIG. 2. In these figures, the impeller pump comprises a case 1, a partition plate 2 for gas-tightly separating a pump chamber 3 from a driving device 4, a supporting shaft 5, a supporting member 6, and a retaining member 7. The impeller pump also includes an impeller 8, a driven magnet 9, and a coil 10, a commutator 11, and an auxiliary magnet 19' that is used to rotate the commutator. In the impeller pump of this embodiment, the coil 10 is energized through the commutator, and the direction of the electric current in the coil 10 is changed to vary a magnetic field. Thus, by the action between the magnetic field and the driven magnet 9, the driven magnet 9 is rotated so that the driven magnet 9 and the impeller 8 rotate together, thereby producing the pumping action. The impeller pump has a construction as noted above.

The impeller pump, which is located at the bottom of a container 20, is used to suck hot water from the container, through the suction port 12 and to discharge such hot water through a discharge port 13 into a discharge pipe 14 for the intended supply. Further, the impeller pump of this embodiment has a guide port 15 surrounding the suction port 12 with a dividing wall 16 interposed therebetween. An outer wall 17 of the guide port 15 is connected with the bottom of the container 20 by a connection member 34. In the impeller pump of this embodiment, once the coil 10 is energized, the driven magnet 9 and the impeller 8 rotate together. By the action of centrifugal force due to the rotation of the impeller 8, liquids lying around the impeller's axis of rotation are moved toward the outside and then discharged through the discharge port 13. As liquids lying around the impeller's axis of rotation are moved toward the outside, this causes a drop in amounts of liquids around the axis of rotation where new liquids are drawn in through the suction port 12. Thus, the flow velocity becomes high at the suction port 12.

By contrast, a region around the guide port 15, which lies away from the axis of rotation, is filled with liquids transferred by centrifugal force. Thus, the liquid's flow velocity becomes low at the guide port 15. Thus, bubbles that were generated in the pump chamber move upward by their own buoyancy, and are released through the guide port 15 into the container 20.

Thus, in accordance with the first embodiment, there is no problem of bubbles gathering at the suction port 12, thereby assuring that the hot-water supply capacity performance is kept constant.

Figure 5:
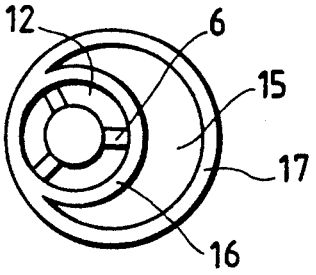
FIG. 5 is a cross-sectional view taken on line V—V of FIG. 4.
Figure 4:
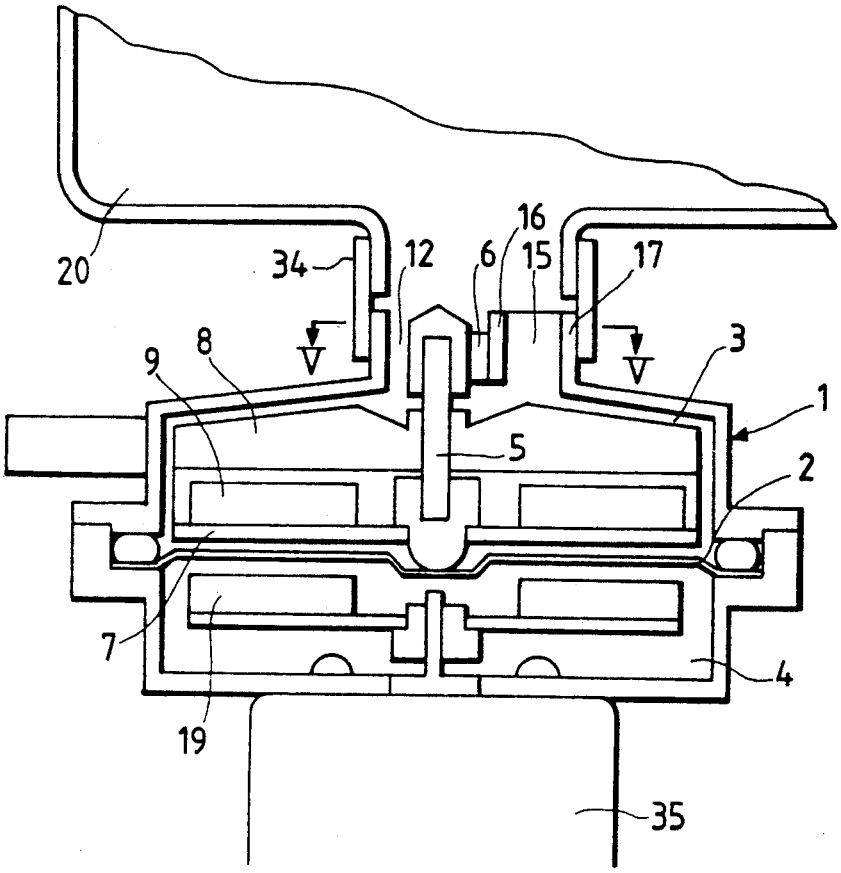
FIG. 4 is a cross-sectional view of a second embodiment of an impeller pump embodying this invention.

FIGS. 4 and 5 are views of a second embodiment of an impeller pump in accordance with this invention. FIG. 4 is a cross-sectional view of the impeller pump, and FIG. 5 is a cross-sectional view taken on line V—V of FIG. 4. In this second embodiment, a guide port 15 is located eccentric to a suction port 12.

Figure 1:
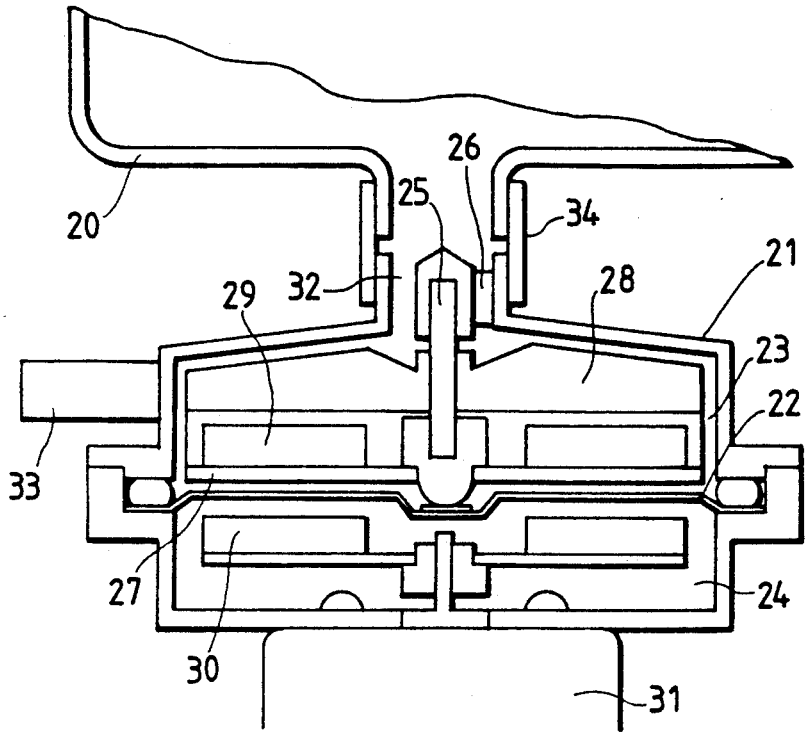
FIG. 1 PRIOR ART
FIG. 1 is a cross-sectional view of an impeller pump of the prior art.

Further, in this second embodiment, as is done in FIG. 1, magnetic coupling between a driving magnet 19 and driven magnet 9 is used to rotate an impeller by an electric motor 35. More particularly, the impeller pump of FIGS. 4 and 5 comprises a casing 1, a partition plate 2 for gas-tightly separating a pump chamber 3 from a driving device 4, a supporting shaft 5 and a supporting member 6. The impeller pump also includes a retaining member 7, an impeller 8, a driven magnet 9, a driving magnet 19 and an electric motor 35.

In this second embodiment, because the guide port 15 is placed eccentric to the suction port 12, if the guide port 15 has the same cross-section as that of FIG. 3, the spacing between the guide port 15 and the suction port 12 increases. This allows bubbles to pass more freely through the guide port 15, thereby providing a more effective release of bubbles into the container 20.

Figure 6:
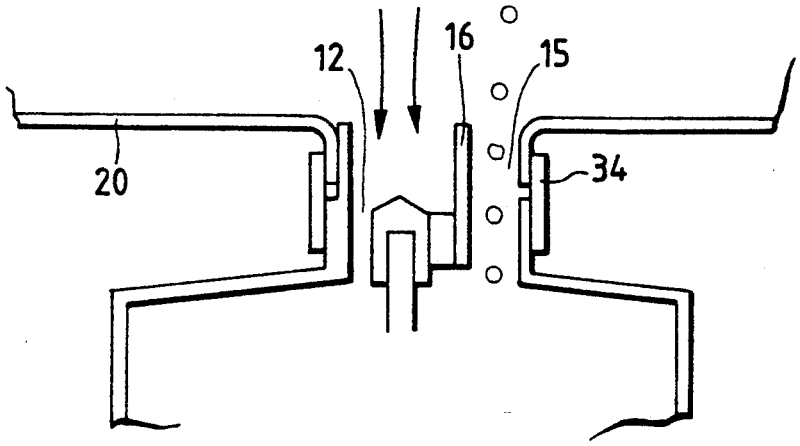
FIG. 6 is a cross-sectional view of a third embodiment of an impeller pump embodying this invention.

FIG. 6 is a cross-sectional view of a third embodiment in accordance with this embodiment showing a suction port and adjacent regions. It should be noted that this third embodiment has an impeller pump of the same type as shown in FIGS. 2 and 4, while the pump itself is not shown in FIG. 6. This third embodiment has a dividing wall 16, which is made greater in length, between a suction port 12 and a guide port 15. Thus, the tip of the dividing wall 16 reaches close by the bottom of the container 20, thereby allowing bubbles to pass more readily through the guide port 15 into the container. This provides a more effective escape of bubbles into the container. Also, there is no problem of bubbles choking off the flow of hot water into the pump chamber through the suction port 12.

Figure 7:
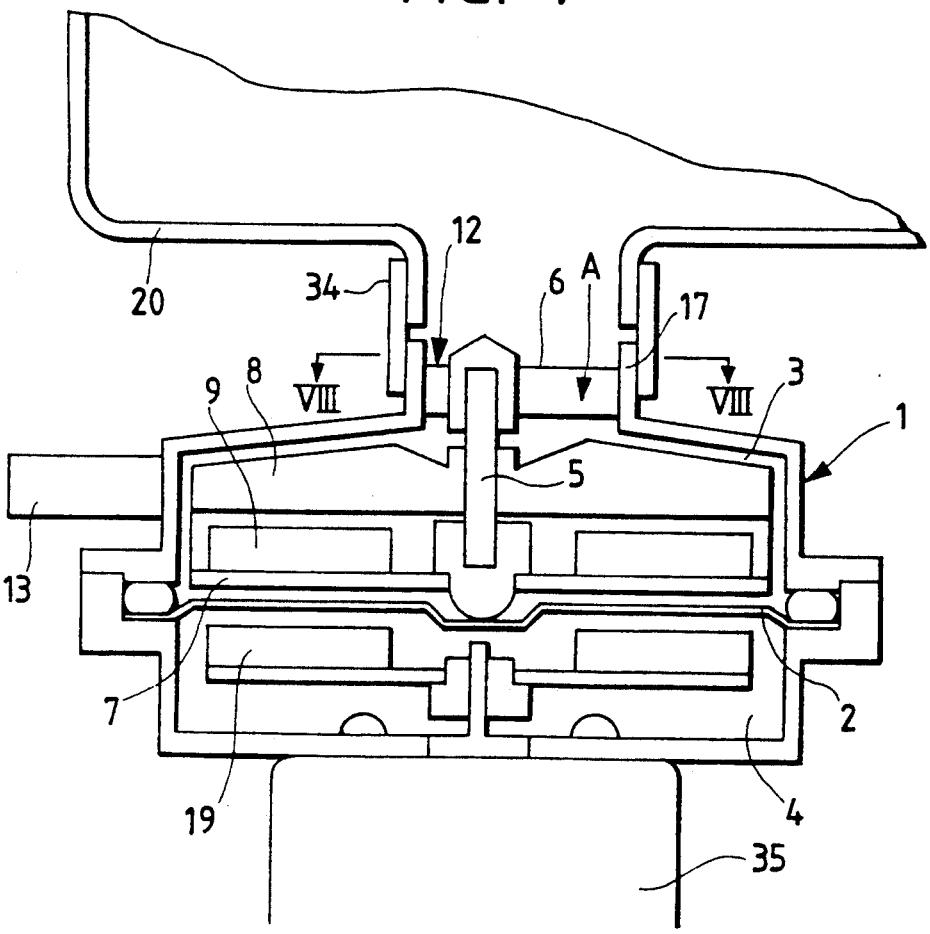
FIG. 7 is a cross-sectional view of a fourth embodiment of an impeller pump embodying this invention.
Figure 8:
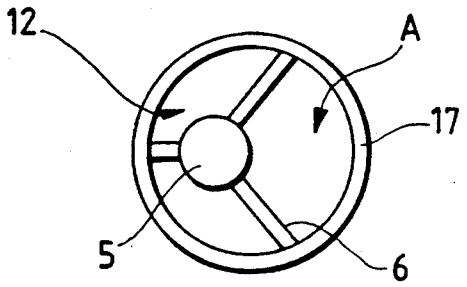
FIG. 8 is a cross-sectional view taken on line VIII—VIII of FIG. 7.

FIGS. 7 and 8 are views of a fourth embodiment of an impeller pump in accordance with this invention. FIG. 7 is a cross-sectional view of the impeller pump, and FIG. 8 is a cross-sectional view taken on line VIII—VIII of FIG. 7. In this fourth embodiment, as is done in the second embodiment of FIG. 4, the impeller pump used is such that magnetic coupling between a driving magnet 19 and a driven magnet 9 is used to rotate an impeller 8. In the fourth embodiment, a suction port 12, which has a slightly larger diameter (say, nearly equal to the diameter of the guide port in other embodiments), is displaced with reference to a shaft 5. Thus, hot water drawn in by the rotating impeller 8 has a higher flow velocity around the shaft 5. By contrast, the flow velocity becomes lower in a region marked as "A" that is away from the shaft 5. Thus, bubbles that move upward by their own buoyancy, tend to pass through the region marked "A" more freely than elsewhere. That is, the region "A" serves to function as a guide port 15 in other embodiments.

Further, the arrangement of supporting members 6 is not limited to that shown in FIG. 8. For example, the spacing between supporting members may be changed. Also, instead of the arrangement shown in FIG. 8, supporting members may be offset at a certain angle to the right or left of the shaft 5.

Figure 9:
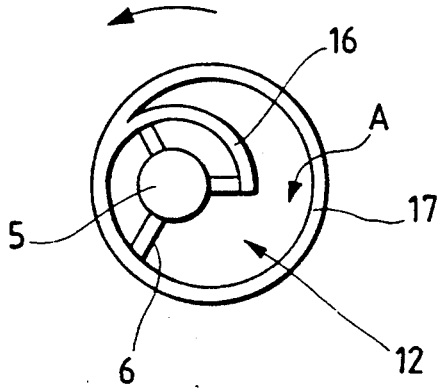
FIG. 9 is a cross-sectional view of a fifth embodiment of this invention showing the suction port and adjacent regions.

FIG. 9 is a cross-sectional view of a fifth embodiment in accordance with this invention showing a suction port and adjacent regions. In this embodiment, a suction port 12 is displaced with respect to a shaft 5. Further, a dividing wall 16 extends from the wall surface of the suction port 12 in the opposite direction to the impeller's direction of rotation (an arrow in FIG. 9). Thus, the flow velocity becomes still lower in the region marked "A" from which bubbles can be released into the container 20 more readily. Further, the length of the dividing wall 16 from the outer wall 17 to the tip may be lengthened or shortened. Also, the dividing wall 16 of FIG. 9 forms an clockwise arc, but it may form an anti-clockwise arc.

Figure 10:
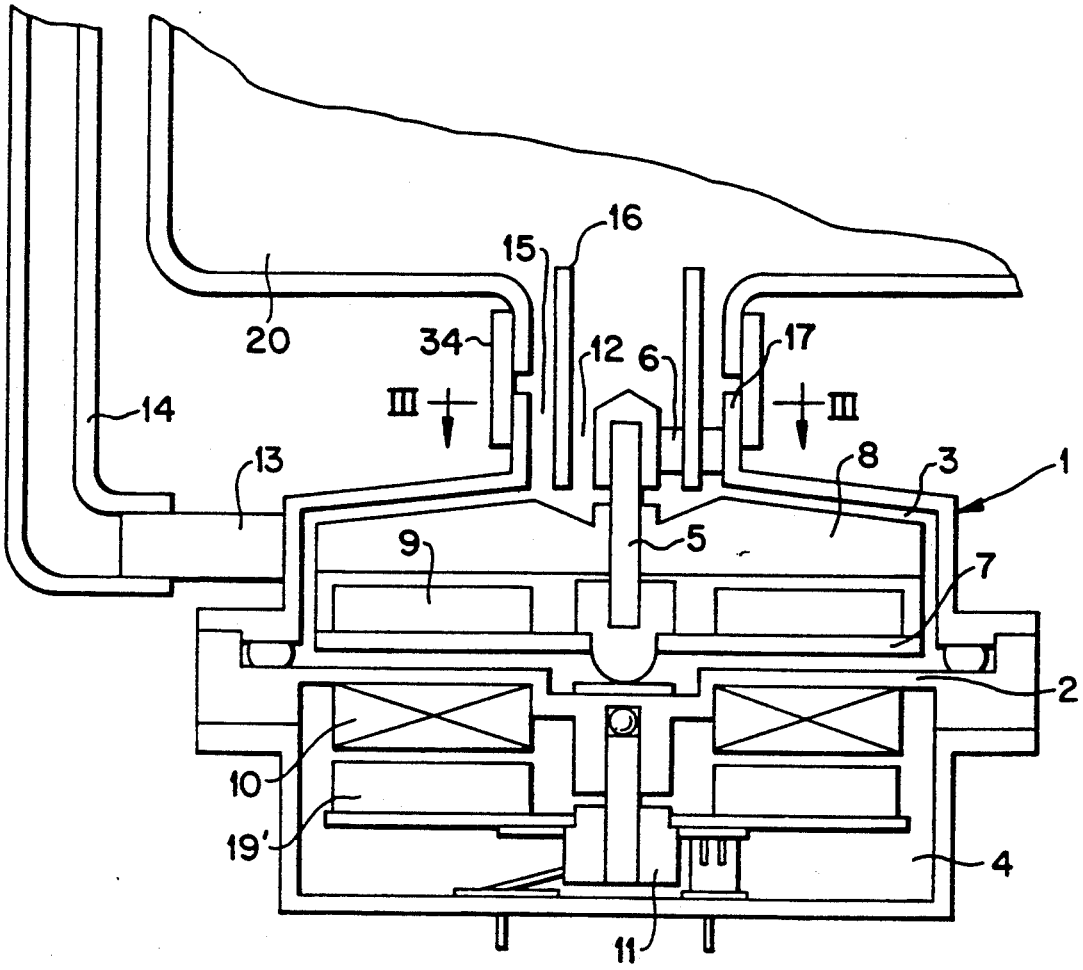
FIG. 10 is a cross-sectional view similar to FIG. 2 but wherein the dividing wall is extended as in FIG. 6.

FIG. 10 is a schematic view showing an embodiment of the present invention that is substantially the same as the embodiment of FIG. 2 but in which dividing wall 16 is extended as in FIG. 6 so that the length of the cylindrical guide port 15 is greater than the length of the outer wall 17 along the impeller's axis of rotation.

It will be understood that the fourth embodiment is substantially the same as the second embodiment of FIGS. 4 and 5, but removing the dividing wall 16 entirely. It is equally the same with the fifth embodiment, wherein part of the dividing wall 16 is removed. It therefore follows that in the second embodiment, even if all or part of the dividing wall 16 is removed, it is equally possible to obtain the working effects of the second embodiment.

Referring to various embodiments explained above, in the first embodiment of FIG. 2, the impeller pump used is such that the driven magnet 9 is rotated by the coil 10, thereby causing the rotation of the impeller. However, as is used in other embodiments, the impeller pump used may be of such a type that magnetic coupling between the driving magnet 19 and the driven magnet 9 is used to rotate the impeller. Further, in the second and fourth embodiments, etc., the impeller pump used is such that magnetic coupling between the driving magnet 19 and the driven magnet 9 is used to rotate the impeller. However, as is done in FIG. 2, the impeller pump used may be of such a type that the driven magnet 9 is rotated by the coil 10, thereby causing the rotation of the impeller. Also, this invention applies to an impeller pump of any other type than those two types noted above.

We claim:

1. A centrifugal pump for supplying a hot liquid from a container comprising:

a pump chamber, an impeller rotatably located in said pump chamber, a cylindrical outer wall, a guide port defined at least in part by said outer wall and connecting said pump chamber and said container, an arched dividing wall concentric with an axis of rotation of the impeller and defining, at least in part, a suction port connecting said pump chamber and said container, and a discharge port formed in said pump chamber, both said suction port and said guide port terminating at an open end thereof in said container, said open ends being adjacent one another and said suction port and said guide port being substantially coextensive, whereby hot liquid is drawn from said container through said suction port and is discharged through said discharge port by rotation of said impeller, and bubbles generated in said pump chamber pass from said pump chamber through said guide port into said container.

2. A centrifugal pump according to claim 1 wherein said suction port is disposed within and concentric with said outer wall.

3. A centrifugal pump according to claim 1 wherein said suction port is disposed within said outer wall and eccentric to said outer wall.

4. A centrifugal pump according to claim 1, wherein a length of said dividing wall is greater than that of said outer wall.

5. A centrifugal pump according to claim 2, wherein a length of said dividing wall is greater than that of said outer wall.

6. A centrifugal pump according to claim 3, wherein a length of said dividing wall is greater than that of said outer wall.

7. A centrifugal pump for supplying a hot liquid contained in a container comprising:

a pump chamber, an impeller rotatably located in said pump chamber, a cylindrical outer wall surrounding and eccentrically disposed with respect to an axis of rotation of said impeller and defining at least a portion of a flow passage between the container and said pump chamber, a suction flow path defined adjacent the axis of rotation of the impeller and bounded at least in part by said outer wall, and a discharge port formed in said pump chamber, whereby hot liquid is drawn from said container along said suction flow path and is discharged through said discharge port by rotation of said impeller, and bubbles generated in said pump chamber pass from said pump chamber through a portion of said flow passage remote from said axis of rotation.

8. A centrifugal pump according to claim 7, wherein said suction port and said flow passage are substantially coextensive.

* * * * *